United States Patent [19]

Brusa

[11] 3,965,637

[45] June 29, 1976

[54] COMPOSITE BLOCK FOR REFRACTORY LININGS OF FURNACES

[76] Inventor: Ugo Brusa, Via Borgnis, Domodossola, Italy

[22] Filed: Feb. 14, 1975

[21] Appl. No.: 550,009

[30] Foreign Application Priority Data

Apr. 2, 1974 Italy ..... 68042/74

[52] U.S. Cl. ..... 52/596; 52/378; 52/727; 52/249; 52/713; 52/575

[51] Int. Cl.[2] ..... E04B 5/04; E04B 1/16

[58] Field of Search ..... 52/596, 727, 728, 598, 52/599, 378, 511, 713, 245, 249

[56] References Cited

UNITED STATES PATENTS

| | | | |
|---|---|---|---|
| 1,915,896 | 6/1933 | Maul | 52/599 |
| 2,071,069 | 2/1937 | Heitman | 52/713 |
| 2,216,813 | 10/1940 | Goldschmidt | 52/596 |
| 2,230,141 | 1/1941 | Heuer | 52/249 |
| 2,238,871 | 4/1941 | Rothbart | 52/599 |
| 2,829,877 | 4/1958 | Davis | 52/599 |
| 3,338,016 | 8/1967 | Bailey | 52/598 |
| 3,376,681 | 4/1968 | DeMaison | 52/511 |
| 3,587,198 | 6/1971 | Hensel | 52/378 |
| 3,712,012 | 1/1973 | Meyer et al | 52/249 |

*Primary Examiner*—Ernest R. Purser
*Assistant Examiner*—Robert Farber

[57] ABSTRACT

A refractory block particularly for lining furnaces intended for heating scrap or ore to be employed in steelmaking, comprises an envelope made of soft steel and a plate of stainless steel welded to the envelope and forming the block face directed towards the interior of the furnace. The envelope is filled with a refractory material, and the plate comprises means by which it is anchored in the refractory material.

12 Claims, 5 Drawing Figures

COMPOSITE BLOCK FOR REFRACTORY LININGS OF FURNACES

The present invention relates to a composite block for the refractory lining of a furnace. More particularly, but not exclusively, the invention relates to a refractory block to be used especially as a lining element for furnaces intended for heating scrap or ore, in natural or prereduced state, to be used in steelmaking.

As known, the refractory furnace linings at present used in the iron and steel industry generally comprise a brickwork or rammings of materials such as dolomite, magnesite, silica, refractory cements and the like, which are subjected to a gradual baking in order to give the lining the desired hardness and cohesion.

Such known linings have however some drawbacks. First of all, the composition of the lining must be studied in each case according to the intended use for the furnace to which the lining is applied.

Moreover said linings tend to become worn in a rather short time, so that they must be replaced frequently, and this causes heavy economic damages due not only to the cost of the material and of the operations required to effect the replacement, but also to the lack of production during the time period in which the refractory lining is rebuilt.

The causes which give rise to a quick wear of the known linings are several. Among these causes one may mention the high temperatures to which the lining is exposed and which in some cases may eventually cause the disgregation or even the fusion of the bricks or layers of refractory material. Another reason is given by the chemical reactions between the treated materials, or some component thereof or the vapors developing therefrom, and the materials of the lining. Lastly, especially in the case of furnaces intended for heating natural or prereduced scrap or ore, the material introduced into the furnace and having sharp edges, especially when it has been subjected to a previous reduction, exerts a great abrasive action.

In order to obviate these drawbacks, the Applicant has conceived a composite refractory block, for lining furnaces, the composition of which has no influence on the material to be treated in the furnace and which is insensitive, or little sensitive, to the disgregating actions exerted by the treated material or the environment of treatment.

A block according to the invention is characterized in that it comprises an envelope made of steel, having substantially the form of a prism, and secured in correspondence of the periphery of one of its side faces to a plate, made of a steel of a type other than that of the envelope and having a greater thickness, which forms the block surface which has to be directed towards the interior of the furnace. The inner space of the said prismatic envelope is filled with a refractory material, for instance a cement, and the plate comprises means allowing its fastening in the said refractory material.

Advantageously the plate is made of a highly stainless steel, whereas the prismatic envelope is made of a steel having a melting point as high as possible, advantageously a soft steel.

Still advantageously, at least when the block according to the invention is used in the lining of a furnace for heating scrap or ore to be used in steelmaking, in which furnace the material moves towards the output and for instance towards a melting basin, the outer face of said plate is provided with a set of grooves parallel to the direction of movement of the material.

Still advantageously, the means allowing to anchor the plate in the mass of refractory material, comprises brackets jutting out from the inner face of the plate, and respective transversal bars, joined to said brackets by rods fastened on one side to the said bars, and on the other side to the said brackets.

The invention will now be described in a more detailed way with reference to the accompanying drawings, in which.

Figure 1:
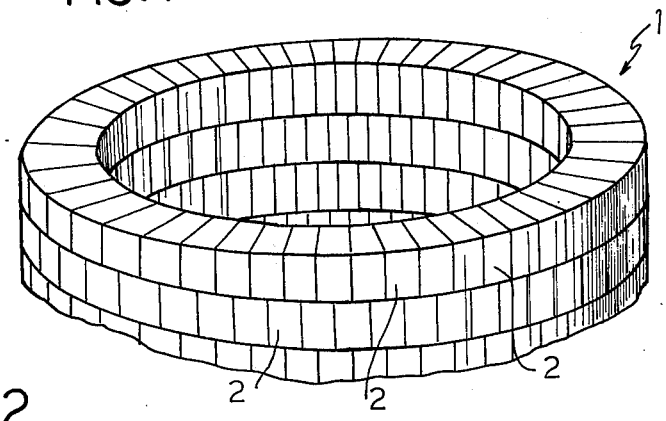
FIG. 1 shows a detail of a refractory lining employing the blocks according to the invention.

As shown in FIG. 1, the refractory lining 1 of a furnace, which in a preferred application of the invention is a furnace for heating scrap or ore to be used in steelmaking, comprises a plurality if adjacent rows of blocks or bricks 2. Preferably, as it is usual when such linings are built, the blocks of one row are offset with respect to the blocks of the contiguous rows, so as to prevent the rising of lines of lower resistance.

Figure 2:
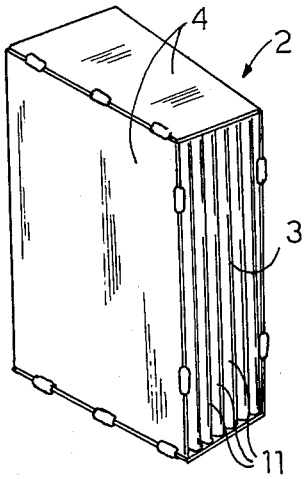
FIGS. 2 and 3 are perspective views, from opposite sides, of a refractory block according to the invention.
Figure 3:
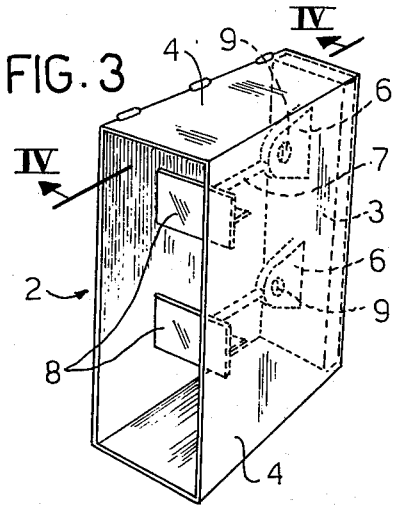
Figure 4:
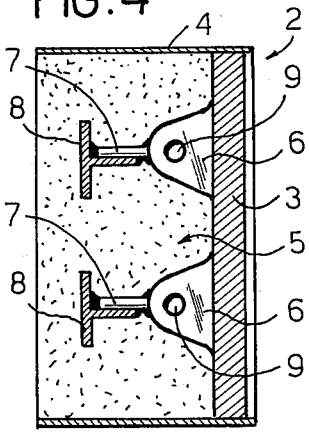
FIG. 4 is a sectional view taken along line IV—IV of FIG. 3.

The blocks 2 (FIGS. 2, 3, 4) have substantially the shape of a hollow prism, and comprises a steel plate 3, and an envelope 4, also made of steel but of different type, secured to the plate 3 in correspondence of the periphery of one side face, and open in correspondence of the face opposite to the plate 3.

In the embodiment shown in the drawings, in which the blocks 2 are intended for use in a lining of cylindrical shape, the envelope 4 has trapezoid bases, and the plate 3 forms the prism face of which two sides are the minor bases of the said trapezoids. Preferably the plate 3 and the envelope 4 are welded to each other.

Advantageously the plate 3, which forms that face of the block which has to be exposed to the inner atmosphere of the furnace, is made of stainless steel, more particularly a nickel-chrome or a nickel-chrome-cobalt steel, whereas the envelope 4, the faces of which in the complete lining are in contact with the corresponding faces of the other blocks 2 and are therefore less exposed to the disgregating agents, will be made of soft steel.

In the complete lining 1 the blocks are merely put in contact, and after the furnace has begun operating, the oxydization at high temperature of the envelope 4 will cause the contiguous blocks to become adhering.

The inner space of each block 2 is filled with a refractory material 5 (FIG. 4), for instance a cement of known type, and the plate 3 is provided with means allowing its anchoring in the said material.

In the embodiment shown in the drawing said means comprises a pair of brackets 6, preferably integral with the plate 3 and arranged in the central longitudinal plane thereof. Each bracket has secured thereto one end of a pin 7, which at the opposed end is secured to a transversal bar 8, preferably made of soft steel and having for instance a T-shaped section, the length of said bar being slightly shorter than the plate width.

Figure 5:
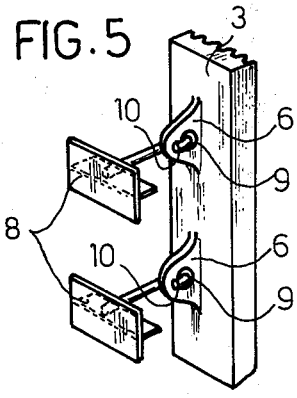
FIG. 5 is a perspective view of a modified plate.

In a first embodiment (FIG. 3) the pins 7 are welded to the respective brackets 6. In a modified embodiment (FIG. 5) the pins may each have a hook-shaped end 10 which engages a hole 9 in the respective bracket 6.

The drawing further shows that the outer face of plate 3 has a plurality of longitudinal parallel grooves 11. In the preferred use of the blocks according to the invention, said grooves make easier the movements of the material within the furnace.

Effected tests have shown that the lining block according to the invention resists much longer than the common refractory bricks the severe conditions of use at high temperature. More particularly the envelope and the metal plate protect the refractory cement from a dangerous thermal shock while providing at the same time a good thermal conductivity both in the heating and in the cooling periods.

It is self evident that the above description is given only by way of non limitative example, and that changes and modifications are possible without going out of the scope of the present invention.

What is claimed is:

1. A composite block for refractory linings of metallurgical furnaces, which block comprises an envelope made of steel, having a substantially prismatic shape with tetragonal bases, a plate, made of steel of a type different from that of the said envelope and secured in correspondence of the periphery of one of the side faces of said envelope, and having a greater thickness than the envelope, said plate forming the block face which has to be exposed towards the interior of the furnace, and means which allow the anchoring of said plate in a mass of refractory material with which the inner space of the said envelope is filled, said plate preventing wear and thermal shock of said refractory material.

2. A block according to claim 1, wherein the said plate is made of a stainless steel.

3. A block according to claim 1, wherein the said envelope is made of a soft steel.

4. A block according to claim 1, wherein the said refractory material with which the inner space of the envelope is filled, is a refractory cement.

5. A block according to claim 1, wherein the said means for anchoring the plate in the refractory material comprises brackets solid with the face of the said plate directed towards the inside of the block, and transversal bars made of steel and joined to the said brackets by pins also made of steel.

6. A block according to claim 5 wherein the said brackets are made of the same steel as the plate.

7. A block according to claim 5 wherein the said pins are welded to the said brackets.

8. A block according to claim 5, wherein said pins have each a hook - shaped end which engages a hole in the respective bracket.

9. A block according to claim 5, wherein the said transversal bars are made of soft steel.

10. A block according to claim 6, wherein the said brackets and plate are realized as a single piece.

11. A block according to claim 1, wherein the said plate is provided on its outer face with a set of parallel longitudinal grooves.

12. A block according to claim 2 wherein said stainless steel is selected from nickel-chrome steel and nickel-chrome-cobalt steel.

* * * * *